US007430790B1

(12) United States Patent
Bowles et al.

(10) Patent No.: US 7,430,790 B1
(45) Date of Patent: Oct. 7, 2008

(54) FELTING MACHINE

(76) Inventors: Don Bowles, 121 Sharpsburg Rd., Sharpsburg, KY (US) 40374; Lanette Freitag, 121 Sharpsburg Rd., Sharpsburg, KY (US) 40374

( * ) Notice: Subject to any disclaimer, the term of this patent is extended or adjusted under 35 U.S.C. 154(b) by 627 days.

(21) Appl. No.: 11/115,082

(22) Filed: Apr. 26, 2005

(51) Int. Cl.
*D04H 18/00* (2006.01)

(52) U.S. Cl. ..... 28/109; 28/107

(58) Field of Classification Search ..... 28/107, 28/108, 109, 115, 110, 111, 112, 113, 114, 28/103, 163, 117, 143; 26/69 R
See application file for complete search history.

(56) References Cited

U.S. PATENT DOCUMENTS

| | | | | | |
|---|---|---|---|---|---|
| 1,389,043 | A | * | 8/1921 | Glasner | 28/108 |
| 2,004,709 | A | * | 6/1935 | Phillips | 28/107 |
| 2,132,530 | A | | 10/1938 | Greiser | |
| 2,574,580 | A | * | 11/1951 | McKay et al. | 28/107 |
| 2,845,687 | A | * | 8/1958 | Howard | 28/114 |
| 3,010,178 | A | * | 11/1961 | Rust, Jr. | 28/107 |
| 3,112,549 | A | | 12/1963 | Smith, II | |
| 3,247,816 | A | | 4/1966 | Polevitzky | |
| 3,431,611 | A | * | 3/1969 | Rentz | 28/112 |
| 3,613,190 | A | | 10/1971 | Crosby | |
| 3,703,752 | A | | 11/1972 | Schulte | |
| 3,725,984 | A | | 4/1973 | Graber | |
| 3,837,054 | A | | 9/1974 | Fehrer | |
| 3,845,529 | A | * | 11/1974 | Van Deusen et al. | 28/109 |
| 3,916,494 | A | | 11/1975 | Konig | |
| D248,274 | S | * | 6/1978 | Kingston et al. | D8/354 |
| 4,891,870 | A | * | 1/1990 | Muller | 28/107 |
| 5,003,674 | A | | 4/1991 | Cohen et al. | |
| 5,873,152 | A | | 2/1999 | Jourde et al. | |
| 5,896,633 | A | | 4/1999 | Fehrer | |
| 5,909,883 | A | | 6/1999 | Jourde et al. | |
| 6,003,215 | A | * | 12/1999 | St. Jacques | 28/115 |
| 6,174,594 | B1 | * | 1/2001 | Smith et al. | 428/218 |
| 6,237,203 | B1 | * | 5/2001 | Sheehan et al. | 28/140 |
| 6,360,412 | B1 | * | 3/2002 | Duval et al. | 28/107 |
| 6,381,818 | B1 | | 5/2002 | Freeman et al. | |
| 6,385,825 | B1 | | 5/2002 | Wang et al. | |
| 6,568,050 | B2 | | 5/2003 | Duval | |
| 6,622,359 | B2 | | 9/2003 | Legl | |

* cited by examiner

*Primary Examiner*—Amy B Vanatta
(74) *Attorney, Agent, or Firm*—Camoriano and Associates; Theresa Fritz Camoriano; Guillermo Camoriano

(57) ABSTRACT

A felting machine for producing fiber art has a wide variety of operating arrangements, providing flexibility for the fiber artist.

13 Claims, 7 Drawing Sheets

FELTING MACHINE

BACKGROUND

Needling or felting machines are used to process wool and other fibers to form the fibers into felt. In the typical felting machine, a fibrous material is carried by a conveyer belt to a pair of parallel rotating feed rollers. The feed rollers pass the fibrous material past a reciprocating needle board. The needle board has a large number of barbed needles which poke the fibrous material, tangling the fibers to form a compacted, felt fabric. The felt then exits via a pair of take-up rollers.

A typical felting machine is designed to produce large quantities of felt material at high speeds. The machines typically are large and operate at high speeds.

BRIEF SUMMARY

The embodiments that are shown and described herein are felting machines intended for use by an artist or craftsman for producing fiber art. They allow a fiber artist to individually design and create rugs, wall hangings, fabrics, placemats, and many other items.

In a preferred embodiment, the felting machine is much smaller than the traditional commercial felting machines, enabling a single person to operate the machine and to reach across the machine to insert materials to be included in the fiber art.

In order to use a felting machine for producing fiber art, it is desirable for the machine to be versatile. In a preferred embodiment, the felting machine has several manually adjustable controls to allow the fiber artist to make adjustments as the material is traveling through the machine. For instance, the speed at which the needles reciprocate is adjustable. Also, the speed at which the fibrous material moves through the machine is adjustable, including providing the ability to place a stationary fiber mat beneath the reciprocating needle board. Further, the direction that the material moves through the machine is reversible. Thus, a fiber artist could begin needling a fiber art creation, stop it, and even reverse it to run it back past the reciprocating needle board. This permits a fiber artist to make a creation with varying textures by needling one area of the creation more heavily than another area and to form a seam in the felt. This also enables the artist to run material back and forth through the machine without operating the reciprocating needle board, which permits the same machine to be used for wet felting. These controls are readily accessible to the fiber artist while he is feeding fibrous material into the machine.

DETAILED DESCRIPTION OF THE PREFERRED EMBODIMENT[S]

Figure 1:
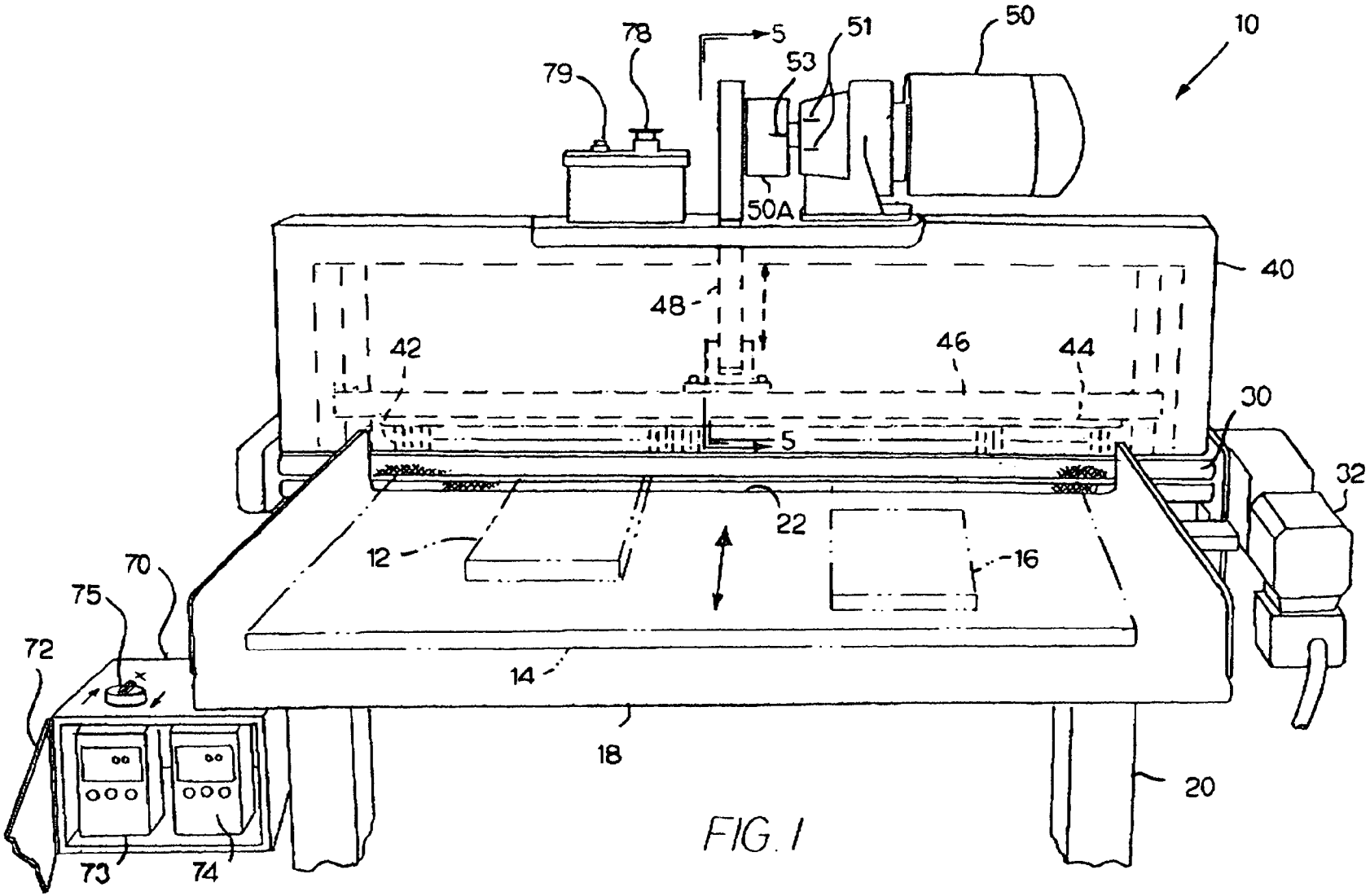
FIG. 1 is a front perspective view of a felting machine made in accordance with the present invention.

FIGS. 1-5 show one example of a felting machine 10 for producing fiber art made in accordance with the present invention. FIG. 1 is a front view of the machine 10. A base piece of fibrous material 14 extends across most of the width of the machine 10, and two pieces of fibrous material 12, 16 lie on top of that base piece 14 and will be appliquéd onto the base material 14 as they pass through the machine 10. The three pieces of fibrous material 12, 14, 16 collectively rest on a feed chute 18, which is supported by a frame 20.

The feed chute 18 provides a surface which supports the fibrous material to be needled. The feed chute 18 also serves as a work surface on which the fiber artist can arrange the fibrous material in various patterns or designs prior to needling. In this case, the artist has placed a rectangular piece 12 and a square piece 16 on top of a larger base piece 14. Of course, the artist can be expected to experiment with various arrangements of fibers and various types of fibers when using the machine 10 to produce fiber art. Once satisfied with the arrangement, the fiber artist feeds the fibrous material to a pair of knurled, vertically aligned feed rollers 30 at the end 22 of the chute 18.

The knurled feed rollers 30 are driven by a motor 32. The fibrous material 12, 14, 16 passes between the upper and lower feed rollers 30 as the rollers 30 are rotated by the motor 32, and the knurls on the rollers 30 grip the fibrous material and convey it forward into a housing 40, where the actual felting of the fibrous material occurs. At the same time, the feed rollers 30 also help compact the fibrous material as it enters the housing 40 (as best shown in FIG. 1B). Although rollers are used in this embodiment, it is also envisioned that belts or other known conveying means could be used instead.

Contained in the housing 40 are the elements that perform the felting of the fibrous material. The felting is done by a plurality of needles 42. The needles 42 are held in place by a base unit known as a needle board 44. The length of the needles 42 may vary, but typically the needles are 3 to 4 inches in length. In this embodiment, the needles are 3½ inches in length. In addition, the number of needles 42 in the needle board 44 may vary, but typically there are 200-500 needles. The arrangement of needles also may vary. In this embodiment, the needles are in parallel rows, and there are four parallel rows of needles (as shown in FIGS. 1A-1C, 5 and 6).

Figure 5:
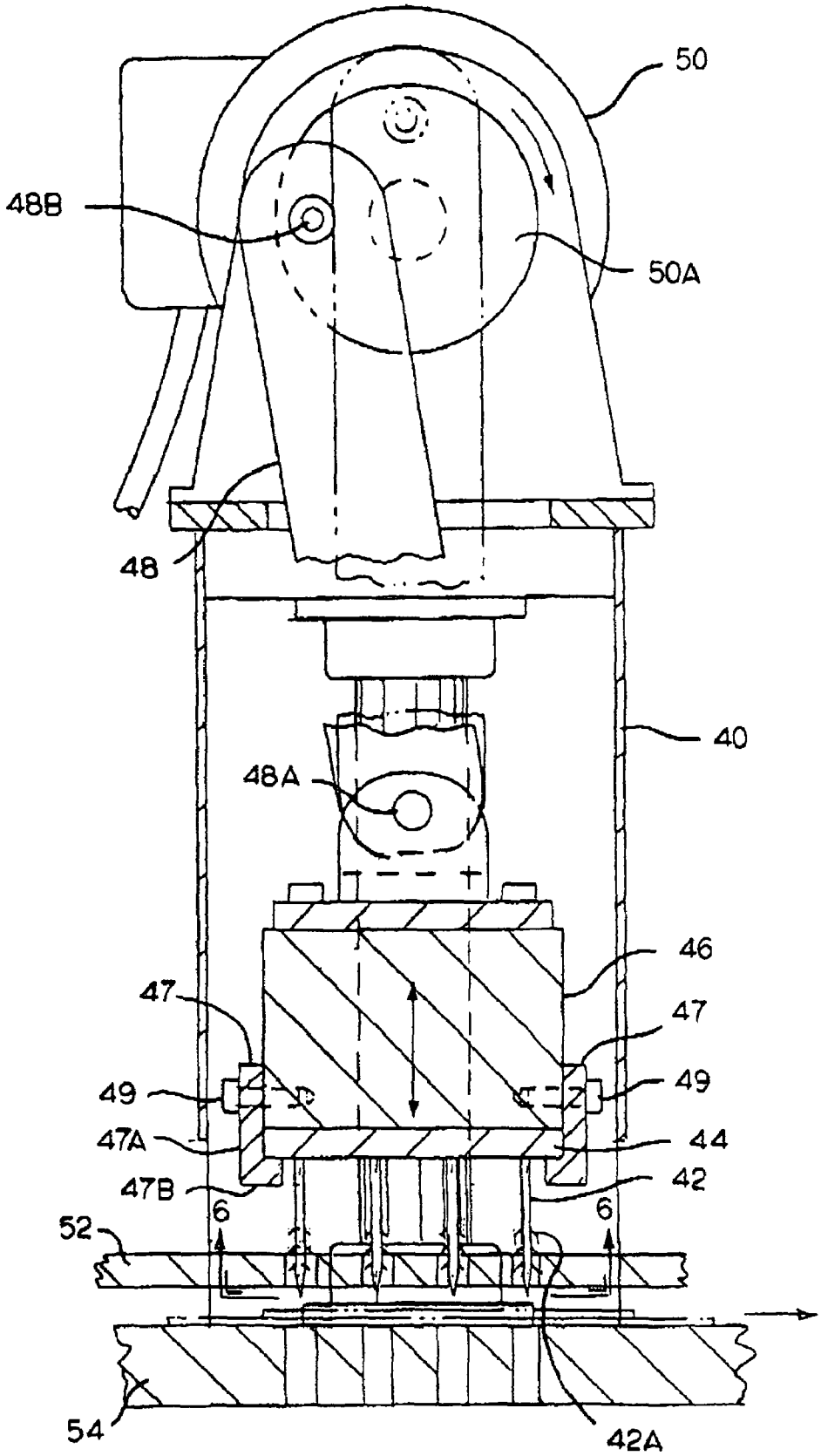
FIG. 5 is a view taken along line 5-5 of FIG. 1.

The needle board 44 is attached to a needle beam 46 which, in turn, is attached to a drive bar 48. The drive bar 48 is driven by a needle board motor 50 situated on top of the housing 40. The details of the needle board driving arrangement will be explained in greater detail later, but the motor 50 essentially drives the needle board 44 in an up and down reciprocating motion. Once the fibrous material enters the housing 40 from the feed rollers 30, the reciprocating motion of the needle board 44 drives the plurality of needles 42 into and out of the fibrous material. As shown in FIG. 5, the needles 42 have barbs 42A, which catch on the fibers, causing the fibers to tangle together to form the felted product.

Figure 1A:
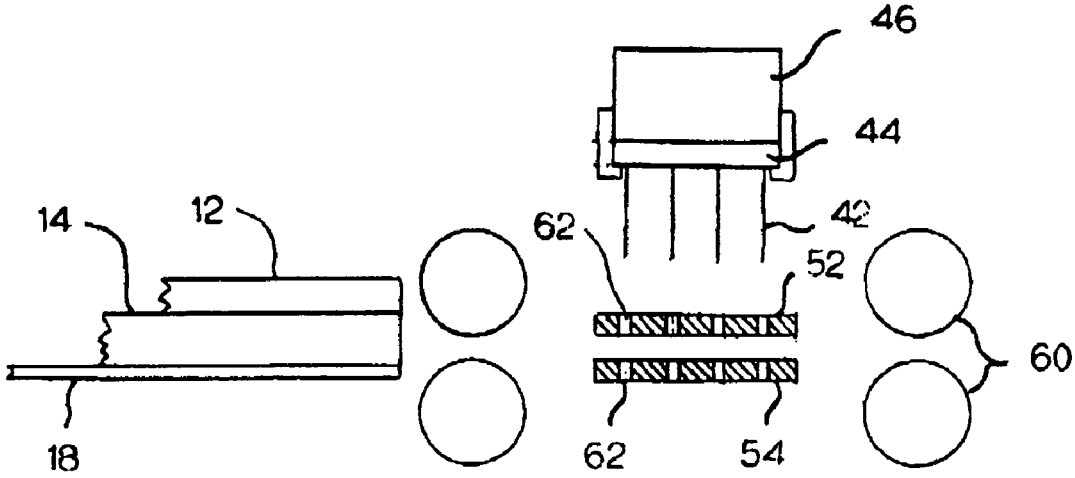
FIG. 1A is a schematic diagram of the felting machine of FIG. 1 before two pieces of fibrous material are needled.
Figure 1B:
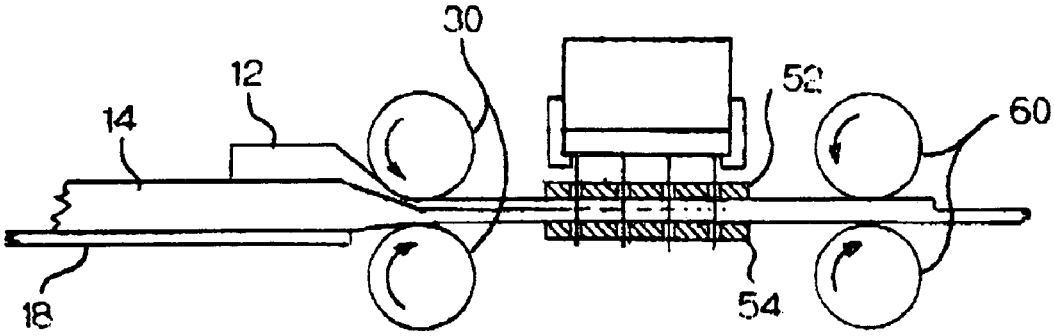
FIG. 1B is a schematic diagram of the felting machine of FIG. 1 while two pieces of fibrous material are needled.
Figure 1C:
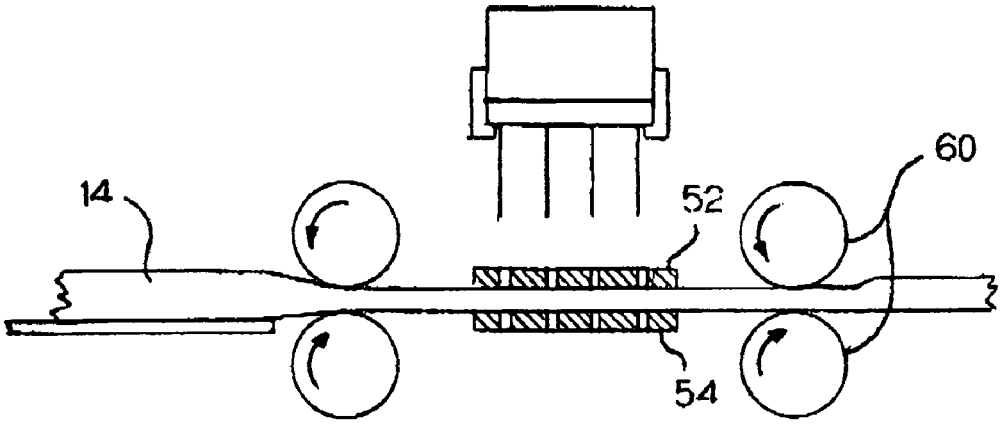
FIG. 1C is a schematic diagram of the felting machine of FIG. 1 after two pieces of fibrous material are needled.
Figure 2:
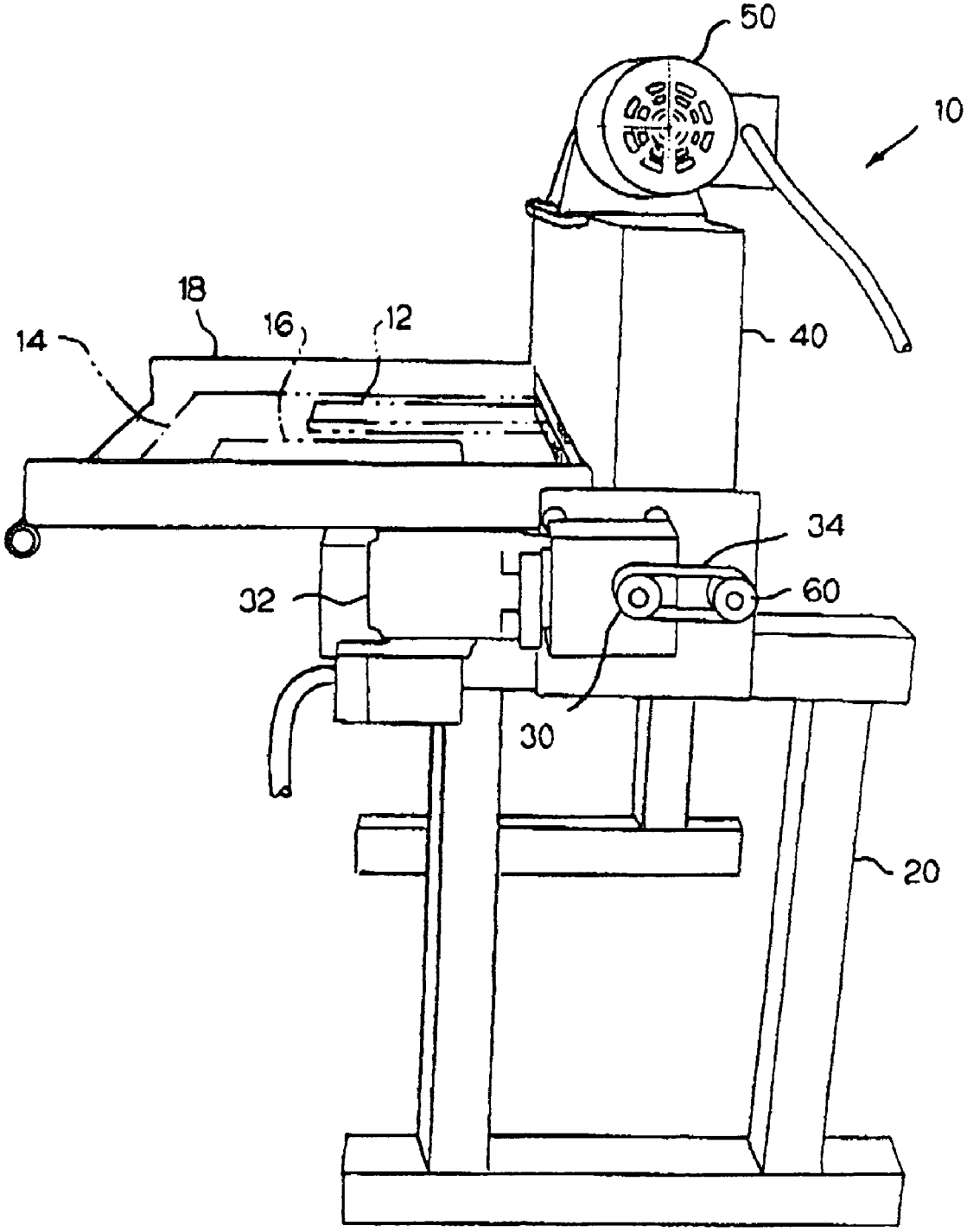
FIG. 2 is a perspective view of the right side of the felting machine of FIG. 1.
Figure 3:
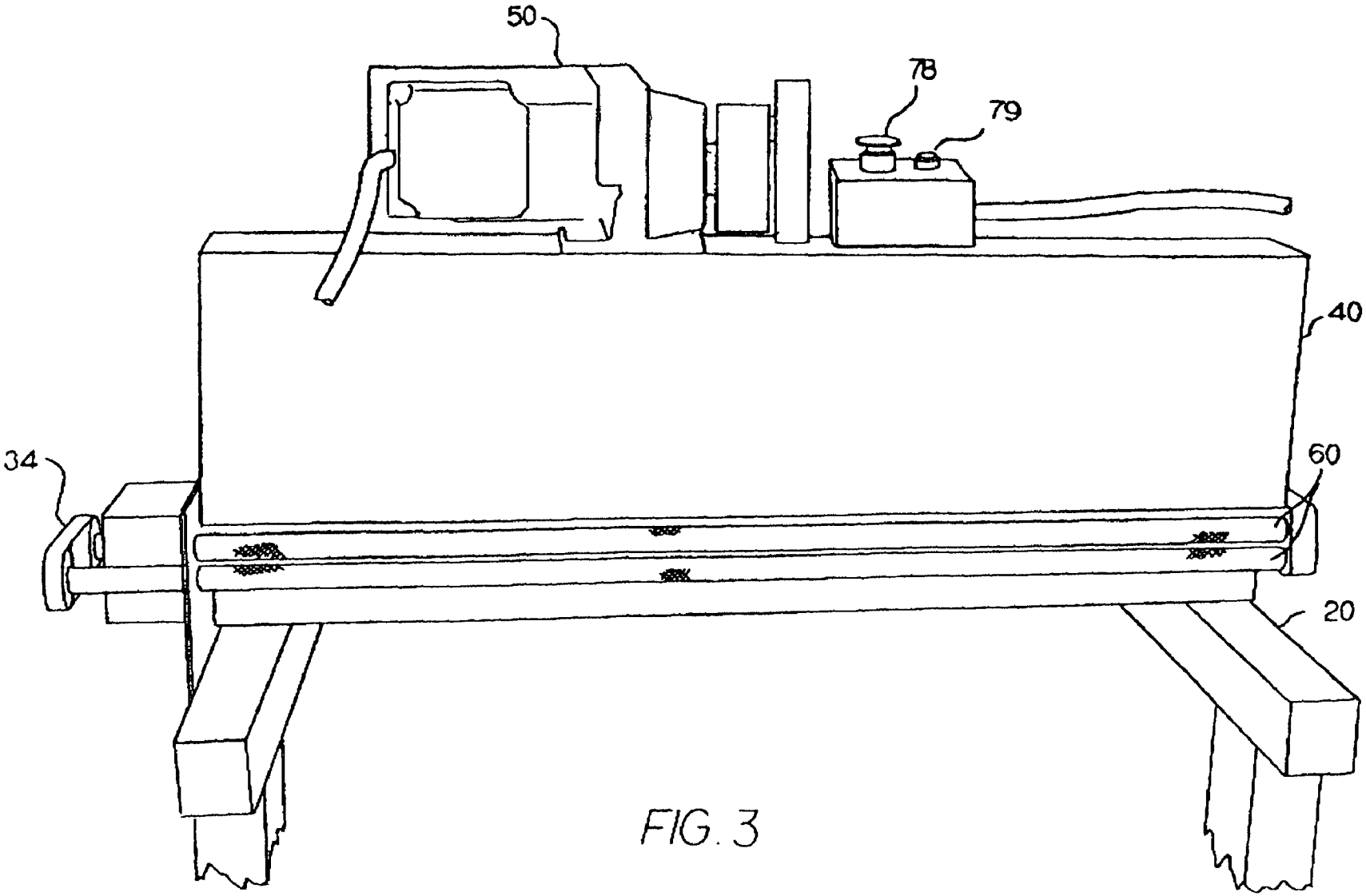
FIG. 3 is a back perspective view of the felting machine of FIG. 1.

A simplified diagram of the felting process is provided in FIGS. 1A to 1C. FIG. 1A shows two pieces of fibrous material 12, 14 resting on the feed chute 18 prior to felting. FIG. 1A also shows the basic components involved in the felting process, including the plurality of needles 42, the needle board 44, and the needle beam 46. Additional basic components not visible in FIG. 1 include a top perforated plate 52, a bottom perforated plate 54, and upper and lower vertically aligned exit or take-up rollers 60. The gap between the top and bottom perforated plates 52, 54 defines a space that contains the fibrous material during the felting, and the exit rollers 60 convey the fibrous material out of the felting machine 10. The perforations 62 in the plates 52, 54 are vertically aligned with each other and provide spaces through which the needles 42 pass as they reciprocate up and down through the fibrous material.

In FIG. 1B, the rollers 30 have started rotating and have conveyed fibrous material 12, 14 into the space between the perforated plates 52, 54. Also, the needle board 44 has descended downwardly so that the needles 42 are now extending through the perforations in the plates 52, 54 as well as through the fibrous material 12, 14. In the downward motion, the needles 42 carry bundles of fibers through the perforations in the bottom plate or bed plate 54. In the upward motion, the top plate or stripper plate 52 strips the fibers from the needles 42 so that the fibrous material 12, 14 can then advance through the machine 10. This process is repeated with each stroke of the needle board, and the fibrous material is extensively poked and tangled to form the felted product, with the upper layer 12 of fibers being secured to the lower layer 14 as both layers are compacted to form a felt material.

In FIG. 1C, the needles 42 have returned to the upper position and are ready to descend again through the fibrous material 14. The fibrous material 12, 14 has been felted, and it is being conveyed away from the machine 10 by the rotation of the exit or take-up rollers 60.

Returning to FIG. 1, the felting machine 10 is equipped with a control box 70 mounted on the frame 20. The control box 70 has a door 72. Inside the control box 70 is a manually adjustable electrical conveyer control 73 and a manually adjustable electrical needle board control 74. Situated on top of the control box 70 is a manually adjustable electrical direction control 75. The controls 73, 74, 75 are readily accessible to a fiber artist who is feeding fibrous material into the felting machine 10. In an alternative embodiment (not shown), the controls may lie on the floor and be operated by foot pedals, or the controls may be contained within a hand-held remote control device, readily accessible for the fiber artist to control the speed of the feed rollers 30, the speed of the needles 42, and the direction of the rollers 30 as he arranges the fibers to be felted.

The manually adjustable electrical conveyer control 73 located in the control box 70 controls the speed at which fibrous material is conveyed through the felting machine 10. In this embodiment, the manually adjustable electrical conveyer control 73 is electrically connected to the motor 32 which drives the feed rollers 30. Adjusting the conveyer control 73 adjusts the speed of the motor 32, which adjusts the speed of rotation of the feed rollers 30, thereby adjusting the speed at which fibrous material is conveyed through the machine 10. In this embodiment, the speed at which fibrous material is conveyed can be adjusted from 0-32 inches per minute. When this control 73 is turned to zero, the rollers do not rotate, and the fibrous material is stationary.

The manually adjustable electrical needle board control 74 located in the control box 70 is electrically connected to the needle board motor 50 and controls the speed at which the needle board 44 reciprocates. In this embodiment, it is adjustable from 0-180 strokes per minute. When turned to zero, the needle board 44 does not reciprocate. The felting machine 10 is also equipped with means for stopping the needle board 44 in the "up" position, allowing a fiber artist to place material precisely beneath the needle board 44. In this embodiment, there are upper and lower markings 51 on the stationary housing of the needle board motor 50, and there is a marking 53 on the rotating output 50A, which drives the needle board 44 up and down. When the marking 53 on the rotating output 50A is between the two markings 51 on the stationary housing, the needle board 44 is at top dead center, so the needles 42 are raised up, in the position shown in FIG. 1A. In order to put the machine in this position, the operator of the machine runs the needle board motor 50 at a very slow speed and then stops it as it approaches top dead center so that, when it stops, it will be at top dead center.

The conveyer control 73 and the needle board control 74 operate independently of each other. In other words, adjusting the conveyer control 73 does not affect the speed at which the needle board reciprocates, and adjusting the needle board control 74 does not affect the speed at which the fibrous material is conveyed. This gives the fiber artist great flexibility. For instance, it is possible to heavily needle the front half of a piece of fibrous material (by either decreasing the conveyer control 73 or increasing the needle board control 74 or both) and lightly needle the back half (by either increasing the conveyer control 73 or decreasing the needle board control 74 or both). It also enables the fiber artist to make a seam in the fibrous material or to leave part of the fibrous material unfelted while felting another portion.

Figure 4:
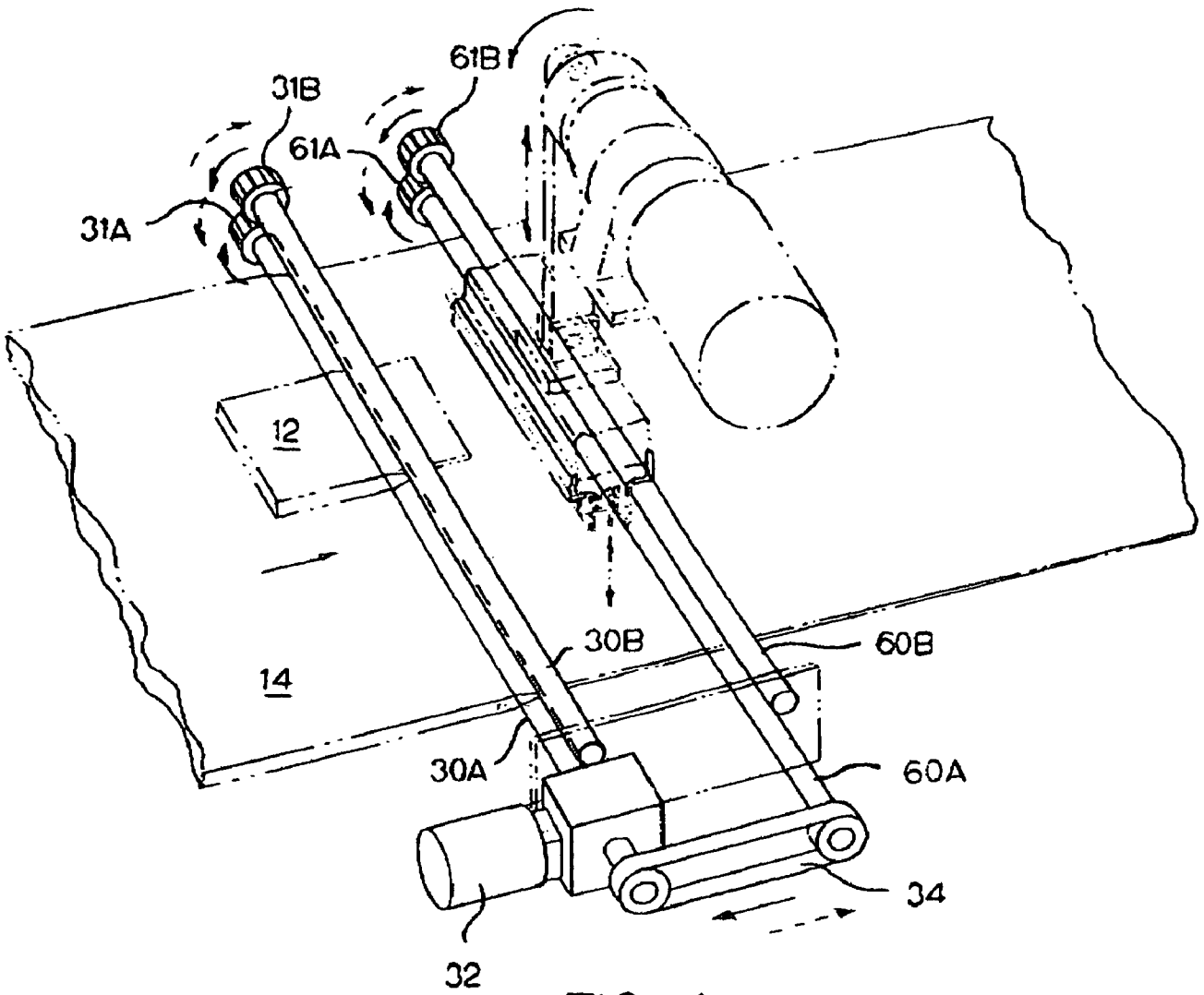
FIG. 4 is a broken away schematic top perspective view of the felting machine of FIG. 1.

The manually adjustable electrical direction control 75 situated on top of the control box 70 controls the direction in which fibrous material is conveyed. It can be set to forward, reverse, or stop. In this embodiment, it is electrically connected to the motor 32. As best shown in FIG. 4, the motor 32 is directly attached to the lower feed roller 30A. When the direction control 75 is set to forward, the motor 32 rotates the lower feed roller 30A clockwise. On the left end of the feed rollers 30, there is a lower feed roller gear 31A engaged with an upper feed roller gear 31B. As the lower feed roller 30A rotates clockwise, the gears 31A, 31B cause the upper feed roller 30B to rotate counterclockwise. Further, the lower feed roller 30A is connected to the lower take-up roller 60A via a belt 34. As the lower feed roller 30A rotates clockwise, the lower take-up roller 60A also rotates clockwise. Gears 61A, 61B on the left end of the take-up rollers 60 cause the upper take-up roller 60B to rotate counter-clockwise as the lower take-up roller rotates clockwise. The result is that all the rollers 30, 60 are simultaneously driven by the motor 32 to convey fibrous material in a front to back direction. FIGS. 1B and 1C also depict the rotation of the rollers 30, 60 as the fibrous material is conveyed in the forward or front to back direction.

When the manually adjustable electrical direction control 75 is set to reverse, it changes the direction of rotation of the motor 32. As noted by the dashed arrows in FIG. 4, the lower feed roller 30A now rotates counterclockwise. Due to the feed roller gears 31A, 31B, the upper feed roller 30B now rotates clockwise. Due to the belt 34, the lower take-up roller 60A now rotates counterclockwise, and the take-up roller gears 61A, 61B cause the upper take-up roller 60B to rotate clockwise. The result is that the rollers are simultaneously driven by the motor 32 to convey fibrous material in a back to front direction Also shown in FIG. 1 is an emergency stop button 78 centrally located on the felting machine 10. The button 78 is centrally situated so that it is clearly visible and easily accessible from either side of the machine. It is a relatively large, red, plunger-type button so that even a passerby can deduce its purpose. When the stop plunger 78 is pressed, the power is cut to all components and the felting machine stops. Next to the stop plunger 78 is a start button 79.

FIG. 5 shows in greater detail the needle board 44 as it is attached to the needle drive motor 50. The needle board 44 is attached to the needle beam 46, which is pivotably attached to the lower end of the drive bar 48 at the pivot point 48A. The drive bar 48 is pivotably attached to a rotating output 50A on the needle drive motor 50 at the pivot point 48B. The pivot point 48A is eccentrically located on the rotating output 50A, so that, as the motor 50 rotates, the drive bar 48 imparts an up and down reciprocating motion to the needle beam 46. If the speed of rotation of the motor 50 is increased (for instance, by the manually adjustable electrical needle board control 74 shown in FIG. 1), then the speed at which the needle beam reciprocates up and down increases. As the needle beam 46 reciprocates up and down, the needle board 44 also reciprocates up and down, and the needles 42 move in and out of the upper and lower perforated plates 52, 54. In this embodiment, the needle board 44 is situated above the perforated plates 52, 54 with downwardly projecting needles 42, however, the needle board 44 could alternatively be situated below the perforated plates 52, 54 with upwardly projecting needles 42.

The needle board 44 is attached to the needle beam 46 by brackets 47. Each bracket 47 has a vertical wall 47A and a horizontal ledge 47B. The vertical wall 47A of each bracket 47 attaches to the side of the needle beam 46. In this case, the brackets 47 are attached with screws 49, but other known means may also be used. The ledge 47B of the bracket extends beneath the needle board 44 and secures the needle board 44 in place against the bottom surface of the needle beam 46.

In prior needle board/needle beam arrangements, the needle board was secured to the needle beam with screws that projected upwardly through the bottom of the needle board and into the bottom of the needle beam. With that design, extensive effort was required to change the needle board, since the underside of the needle board was crowded with needles and not easily accessible. The brackets 47 make it easy to change the needle board 44, because the vertical wall 47A of the bracket 47 is easily accessible from the front or back of the machine 10 once the housing 40 is removed.

This needle board arrangement makes it not only easy to replace the needle board when necessary (i.e. when needles break), but allows the flexibility of quickly and easily changing the needle board for different applications. Various needle types and arrangements can be used for felting. There are needles of all shapes and sizes, some with barbs and some without barbs, and those with barbs have a wide variety of barb designs. With this needle board/needle beam configuration, the fiber artist can keep a number of needle boards with different types of needles on-hand and can quickly change out needle boards when desired.

In addition, the fiber artist has the flexibility to use more than one needle board with the same needle beam. The needle beam 46 of this particular felting machine 10 is 36 inches long, and it is envisioned that the artist will use needle boards that come in 12 inch lengths and that the brackets 47 also will come in 12 inch lengths, making it easy to change out just one needle board at a time. Thus, the fiber artist may use up to 3 different needle boards 44 with the same needle beam 46 in this embodiment. This allows the artist to achieve different effects on different parts of the felted material simply by using different types of needle boards on those different parts.

Figure 6:
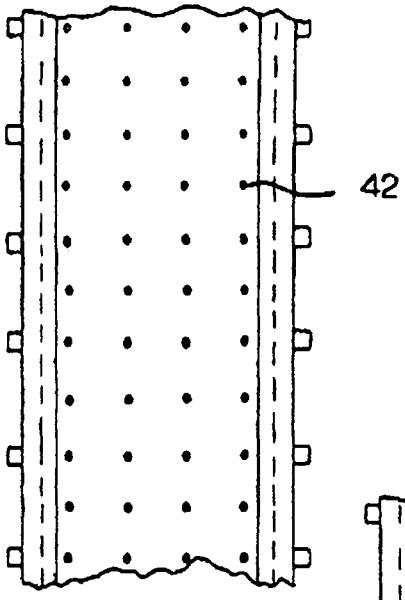
FIG. 6 is a view taken along line 6-6 of FIG. 5 showing the needle pattern.
Figure 6B:
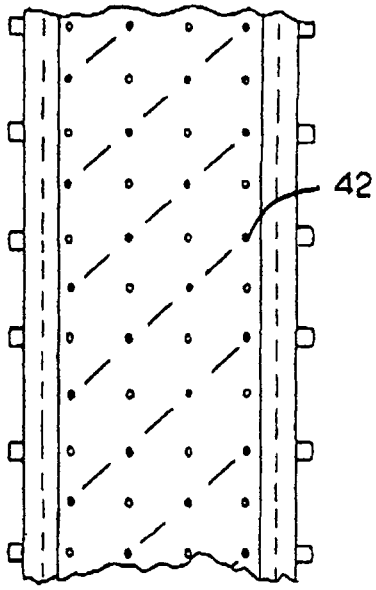
FIGS. 6A-6D are views taken along line 6-6 of FIG. 5 of alternative needle patterns.
Figure 6A:
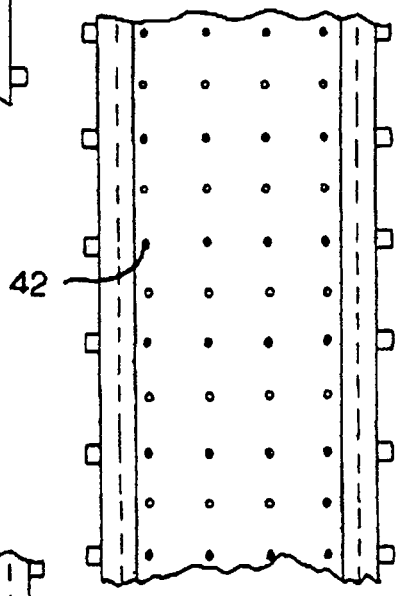
Figure 6C:
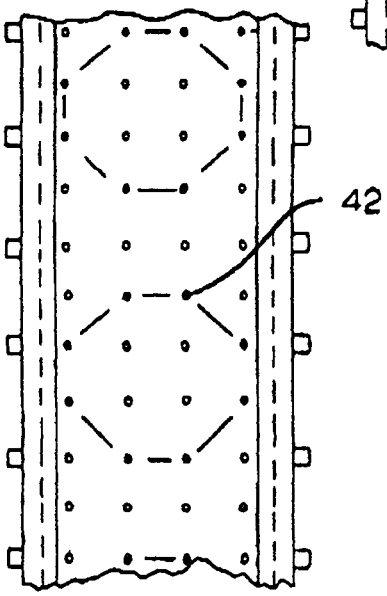
Figure 6D:
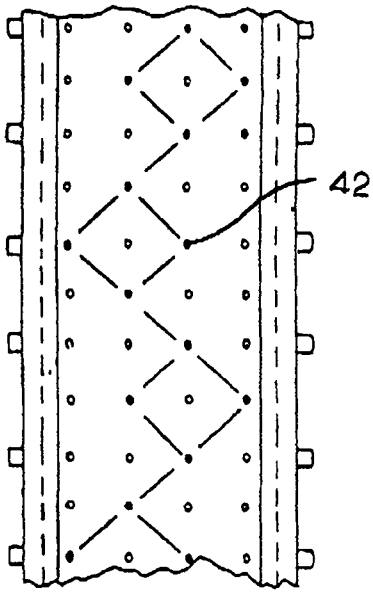

In addition, the fiber artist can use needle boards that have different needle arrangements. FIGS. 6A-6D provide examples of some arrangements that could be substituted for the basic needle board arrangement shown in FIG. 6. FIGS. 6 and 6A-6D are views taken along line 6-6 in FIG. 5 looking upward at the needles 42 through the stripper plate 52. It should be noted that these arrangements are completely compatible with both the top and bottom perforated plates 52, 54 (shown in FIGS. 1A-1C, 5), with each of the needles 42 being aligned with respective holes in the plates, so that no further modifications are needed after swapping the needle boards. The solid lines connecting the needles 42 in FIGS. 6B-6D are included only as an aid in viewing the patterns of the needles 42. In addition to needle arrangements, it is also possible to use blank boards, or boards that have no needles. For instance, a fiber artist may place a 12 inch blank board in the center of the needle beam with 12 inch needle boards on each side. This would create an unfelted region down the center of the fibrous material with felted regions on each side.

The flexibility of this machine 10 allows a fiber artist to do many things that were previously impractical. For example, the felting machine makes it very easy to create a seam between two pieces of material. This is accomplished by stopping the reciprocating needles in the "up" or top dead center position and feeding two overlapping pieces of fibrous material into the machine directly beneath the needles. Once the section of overlapping pieces is directly under the needle board, the movement of the fibrous material is stopped. The artist then adjusts the controls so the needle board reciprocates while the feed rollers 30 remain stationary, until the two pieces are sufficiently felted together to create a satisfactory seam. The overlapping pieces may actually be two ends of the same piece, so that the seam forms the felted fiber into a tubular arrangement. If desired, the tube can then be turned inside-out to hide the seam better.

Being able to stop the needles in the "up" or top dead center position allows the artist to move the fiber to the exact location desired for applying additional felting for edges, ends, or special effects. It also provides the capability of repositioning the material to a specific location for repair felting. It also provides the capability of wet felting the piece to provide a surface variation for artistic purposes. Wet felting can be achieved by wetting the materials and repeatedly running them back and forth through the rollers. This may be accompanied by needle felting before, after, or even during the wet felting, if desired. Thus, this machine has the capability of being used both for wet felting and dry felting and for a combination of wet and dry felting.

An example of one special effect is that the artist can put a special, unfelted fiber, such as a naturally curly fiber that has been washed but not carded or pulled apart, on top of a base fiber, and then needle along the ends of the special fiber to felt it into the base material while preserving the natural curl and crimp of the original fiber. The locks of the fleece are kept intact, thus providing the artist additional surface sculpture capability. This may be done at the edge of the base material, to provide a fringe effect, or in the middle of the base material, wherever desired.

For example, looking again at FIG. 1, the upper layer 12 may be an unfelted, uncarded fiber, lying on top of the base material 14. One end of the upper layer 12 may be placed below the needle bar 44, and the feed rollers 30 may be stopped so that just the end of the upper fibers 12 is secured to the base material 14, leaving the rest of the upper layer 12 unfelted.

It will be understood that safety shields may be added to the machine to prevent an operator from accidentally contacting the needles, and the safety shields may be made of a transparent material so the operator can watch the operation of the needle board and can watch the material as it passes through the machine.

It will be obvious to those skilled in the art that modifications may be made to the embodiments described above without departing from the scope of the present invention.

What is claimed is:

1. A felting machine for producing fiber art, comprising:

a frame defining a front, back, left side, right side, top, and bottom;

upper and lower perforated plates mounted on said frame with at least some of the perforations in the plates being vertically aligned;

a needle board including a plurality of vertically projecting needles mounted for up and down reciprocating motion through the aligned perforations in said perforated plates;

a stationary work surface on the front side of said needle board for supporting fibrous material to be needled;

a conveyer, at least part of which is located between said stationary work surface and said needle board, including at least one propelling element which propels fibrous material in a front to back direction between said perforated plates; and an adjustable electrical conveyer control that controls the speed of said conveyer, said conveyer control being readily accessible to a fiber artist who is standing adjacent said stationary work surface, arranging fibrous material on said stationary work surface, and feeding fibrous material from said stationary work surface into said conveyer.

2. A felting machine for producing fiber art as recited in claim 1, and further comprising:

an adjustable electrical needle board control that controls the frequency of reciprocation of said needle board, said needle board control being readily accessible to a fiber artist who is standing adjacent said stationary work surface and feeding fibrous material into said conveyer; wherein said controls include means for stopping the reciprocation of the needle board while the conveyor is running and means for stopping the conveyor while the needle board is reciprocating.

3. A felting machine for producing fiber art as recited in claim 2, and further comprising:

an electrical direction control for controlling the direction of said conveyer between forward and reverse directions so that said conveyer may alternately convey fibrous material in a front to back direction and in a back to front direction, said direction control being readily accessible to a fiber artist who is standing adjacent said stationary work surface and feeding fibrous material into said conveyer and said direction control including means for changing the direction of said conveyor both while the needle board is stationary and while the needle board is reciprocating.

4. A felting machine for producing fiber art as recited in claim 1, wherein said conveyer includes:

upper and lower feed rollers on the front side of said needle board;

upper and lower take-up rollers on the back side of said needle board; and a motor drivingly engaged to both said feed rollers and said take-up rollers so that the feed roller and take-up rollers rotate together.

5. A felting machine for producing fiber art as recited in claim 4, wherein said feed rollers and said take-up rollers are knurled.

6. A felting machine for producing fiber art as recited in claim 4, and further including means for permitting a fiber artist to easily reach in from the side of said stationary work surface to apply fibrous materials along the entire width of the material to be felted.

7. A felting machine for producing fiber art as recited in claim 3, wherein said conveyer includes:

upper and lower feed rollers on the front side of said needle board; upper and lower take-up rollers on the back side of said needle board; and a motor drivingly engaged to both said feed rollers and said take-up rollers so that the feed roller and take-up rollers rotate together.

8. A felting machine for producing fiber art, comprising:

a frame defining a front, back, left side, right side, top, and bottom;

upper and lower perforated plates mounted on said frame with at least some of the perforations in the plates being vertically aligned;

a needle board including a plurality of vertically projecting needles mounted for up and down reciprocating motion through the aligned perforations in said perforated plates;

a conveyer including at least one propelling element which propels fibrous material in a front to back direction between said perforated plates;

an adjustable electrical conveyer control that controls the speed of said conveyer; and an adjustable electrical needle board control that controls the frequency of reciprocation of said needle board;

wherein said adjustable electrical conveyer control and said adjustable electrical needle board control are independent of each other, including means for stopping the reciprocation of the needle board while running the conveyor; and means for stopping the conveyor while running the needle board.

9. A felting machine for producing fiber art as recited in claim 8, wherein said upper and lower plates define a space between them, and further comprising means for reliably stopping said reciprocating needle board with said needles lying outside of the space between said plates to allow fibrous material to be moved within that space without contacting said needles.

10. A felting machine for producing fiber art, comprising:

a frame defining a front, back, left side, right side, top, and bottom;

upper and lower perforated plates mounted on said frame and generally extending in a left to right direction, said plates defining a plurality of aligned perforations and defining a space between said plates;

a needle board mounted on said frame for up and down reciprocating motion, including a plurality of vertically projecting needles which pass through the aligned perforations in the upper and lower plates as the needle board reciprocates;

a conveyer including at least one propelling element which propels fibrous material in a front to back direction between said perforated plates;

means for driving said needle board in an up and down reciprocating motion;

an adjustable electrical conveyer control that controls the speed of said conveyer; and means for reliably stopping said needle board in a position in which the needles are outside the space between said plates both while the conveyor is running and while the conveyor is stopped so that fibrous material can be moved between the plates both manually and by means of the conveyor without encountering the needles.

11. A felting machine for producing fiber art as recited in claim 10, and further comprising:

a first set of rollers on the front side of said needle board;

a second set of rollers on the back side of said needle board;

a motor drivingly engaged to said first and second sets of rollers, such that both sets of rollers rotate together; and an electrical direction control for controlling the direction of rotation of said rollers so that said rollers may alternately convey fibrous material in a front to back direction and in a back to front direction, said direction control including means for changing the direction of rotation of said rollers while the needle board is reciprocating and while the needle board is stopped.

12. A felting machine for producing fiber art as recited in claim 11, and further comprising:

an adjustable electrical speed control for controlling the speed of the rollers; and an adjustable electrical speed control for controlling the speed at which the needle board reciprocates.

13. A felting machine for producing fiber art, comprising:

a frame;

a conveyor for conveying fibrous material relative to said frame;

a needle beam having a top surface, a bottom surface, and at least one vertical side surface extending between said top and bottom surfaces, said needle beam being mounted for up and down reciprocating motion relative to said frame;

a needle board mounted on said needle beam, said needle board having a top surface and a bottom surface, wherein said top surface of said needle board lies adjacent said bottom surface of said needle beam, and wherein a plurality of needles project downwardly from the bottom surface of the needle board;

a removable L-shaped bracket having a vertical wall and a horizontal ledge, wherein said vertical wall is secured to the vertical side surface of the needle beam and the horizontal ledge extends beneath a portion of said needle board, securing the needle board to the needle beam; and further comprising a plurality of fasteners extending through the vertical wall of the bracket and into the needle beam.

* * * * *